United States Patent [19]

Pierrel et al.

[11] 4,129,171

[45] Dec. 12, 1978

[54] INSTALLATION FOR HANDLING SOCKET CORES FOR A CENTRIFUGAL CASTING MACHINE

[75] Inventors: Michel Pierrel; Roger Malivoir, both of Pont-a-Mousson, France

[73] Assignee: Pont-a-Mousson S.A., Nancy, France

[21] Appl. No.: 851,318

[22] Filed: Nov. 14, 1977

Related U.S. Application Data

[63] Continuation of Ser. No. 689,412, May 24, 1976, abandoned.

[30] Foreign Application Priority Data

Jun. 27, 1975 [FR] France ..... 75 20238

[51] Int. Cl.[2] ..... B22D 13/00; B22D 33/04

[52] U.S. Cl. ..... 164/292; 164/302; 164/340

[58] Field of Search ..... 164/292, 302, 340, 341, 164/397, 137, 286, 298

[56] References Cited

U.S. PATENT DOCUMENTS 3,191,245 6/1965 Cooper et al. ..... 164/302 X 3,412,785 11/1968 Lorang ..... 164/302 X

FOREIGN PATENT DOCUMENTS 221226 7/1968 U.S.S.R. ..... 164/302

*Primary Examiner*—Richard B. Lazarus

*Attorney, Agent, or Firm*—Sughrue, Rothwell, Mion, Zinn and Macpeak

[57] ABSTRACT

The installation comprises a first core support pivotable about a fixed axis between a horizontal position and vertical position. The core is mounted on the first support. A second core support having a horizontal axis is provided with a core gripping device and is movable between the first core support, in which it receives the core from the first core support in the vertical position of the first support, and the socket end of a centrifugal casting mould. The two supports are provided with a device for mutually centering the two supports when transferring the core from one support to the other.

20 Claims, 14 Drawing Figures

FIG_1
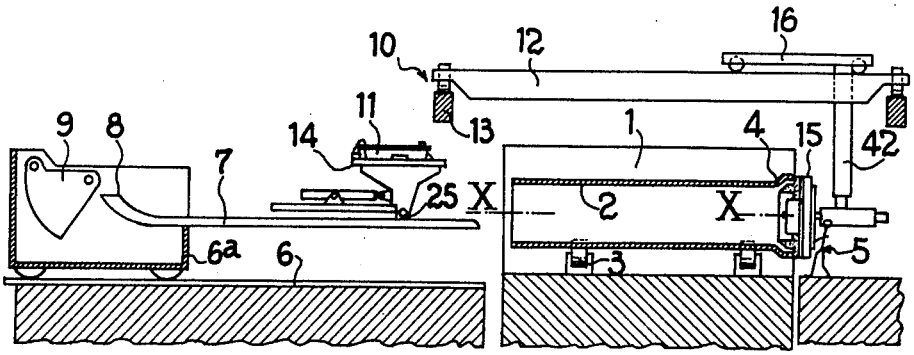
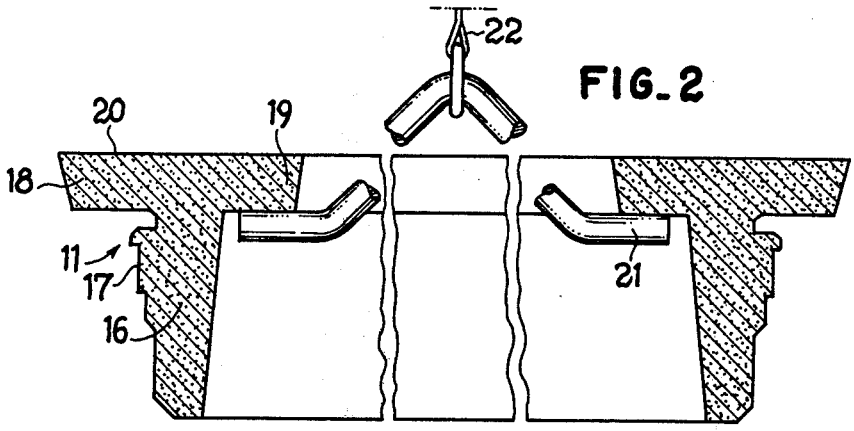
FIG_2
FIG_5
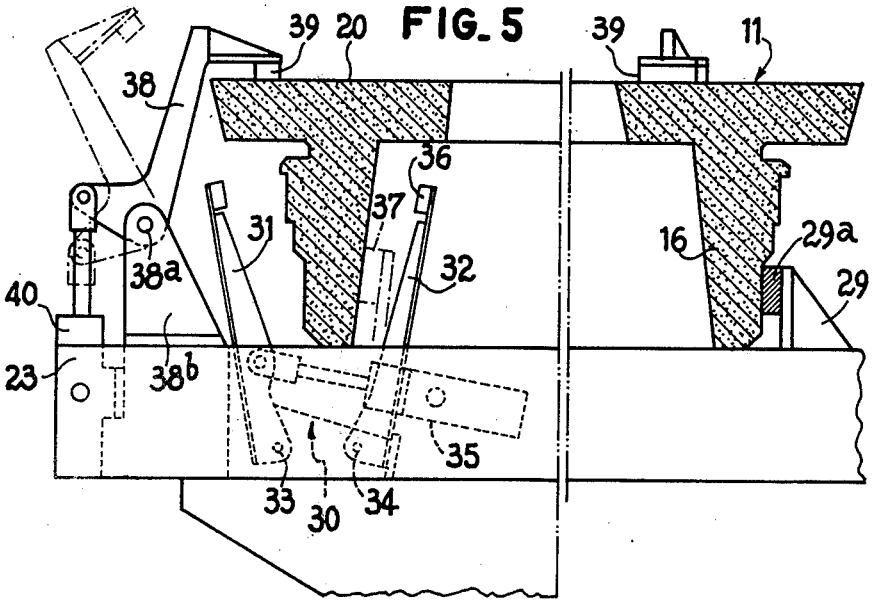

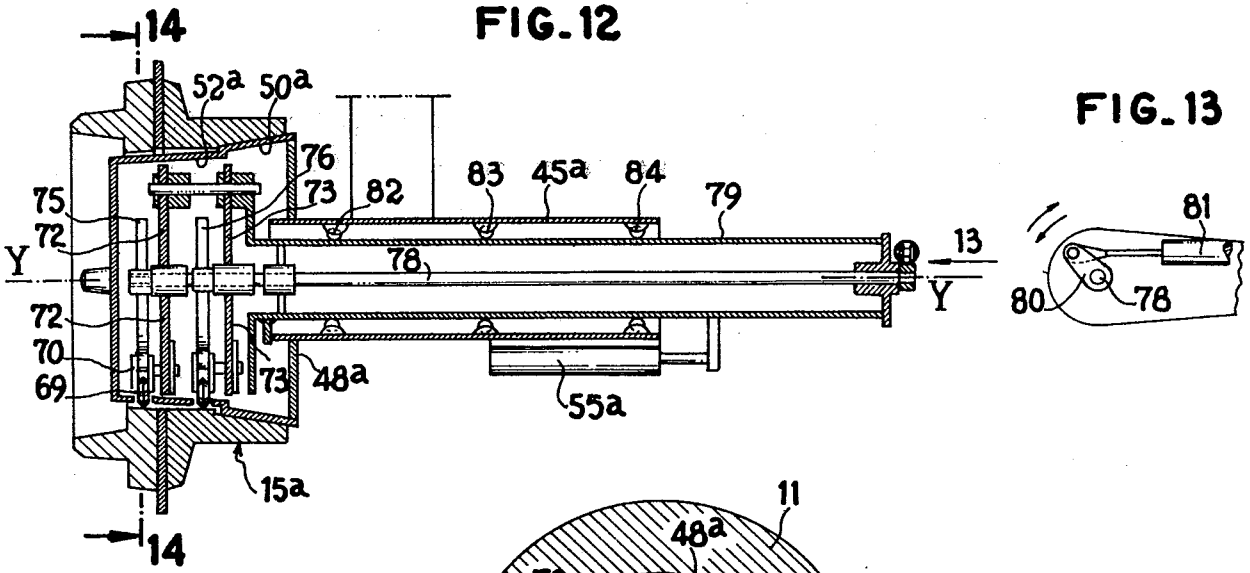
FIG. 12
14
52a
50a
76
73
82
83
45a
84
79
78
48a
73
15a
55a
13
Y
75
72
72
70
69
Y
14
FIG. 13
81
78
80
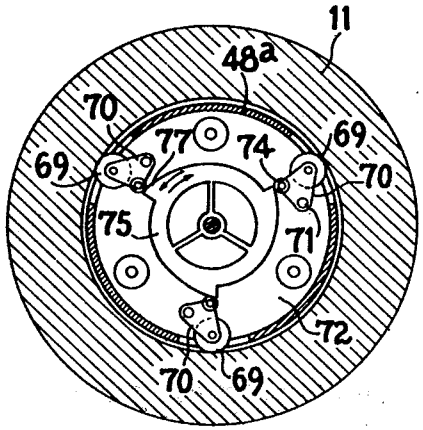
FIG. 14
11
48a
69
70
72
71
74
77
75
70
69
70
69

INSTALLATION FOR HANDLING SOCKET CORES FOR A CENTRIFUGAL CASTING MACHINE

This is a continuation, of application Ser. No. 689,412, filed May 24, 1976, and now abandoned.

The present invention relates to an installation for handling socket cores for fixing in a socket end of a centrifugal casting mould.

More particularly, but not exclusively, the invention relates to the handling of cores for the centrifugal casting of large-diameter iron pipes, for example of at least 800 mm and up to 2000 mm in diameter in the present state of the art.

Such cores are annular in shape, made entirely from sand agglomerated by a hardening binder and are very heavy. Notwithstanding their weight, they must be brought rapidly from the station where they are produced to their position in the mould. They must be fitted with precision in the socket of the mould before being automatically locked. Thus they move from a flat position (vertical axis) at the station of production to a position on edge (horizontal axis) in the mould.

An object of the invention is to provide a handling installation which is particularly adapted to large-diameter cores and which enables all the movements and rotations required for each core to be effected with no direct manual intervention.

According to the invention, there is provided an installation for handling socket cores intended to be fixed in the socket end of a centrifugal casting mould, said installation comprising a first core support pivotable about a fixed axis between a horizontal position and a vertical position and provided with means for positioning and maintaining a core, and a second core support having a horizontal axis movable between the first support and said socket end of the mould and provided with means for gripping the core, the two supports being provided with mutual centering means.

Another object of the invention is to provide a core which is in particular intended to be handled by such an installation, said core being of the type comprising an annular skirt portion provided at one end with an outer annular flange, the flange being extended by a second flange inside the skirt portion.

Further features and advantages of the invention will be apparent from the ensuring description given merely by way of a non-limitative example with reference to the accompanying drawings in which:

FIG. 1 is a diagrammatic sectional view, to a small scale, of a centrifugal casting machine associated with a core handling installation according to the invention;

FIG. 2 is a sectional view, to an enlarged scale, of a socket core according to the invention, suspended from a simple swing bar of the installation in the course of a first stage of the handling of the core;

FIG. 5 is a partial sectional view, to an enlarged scale, of the support shown in FIG. 3;

FIG. 12 is a sectional view of a second embodiment of the second support of the handling installation according to the invention;

FIG. 13 is a partial view of the embodiment shown in FIG. 12 viewed in the direction of arrow 13 of FIG. 12, and FIG. 14 is a sectional view taken on line 14—14 of FIG. 12.

Figure 8:
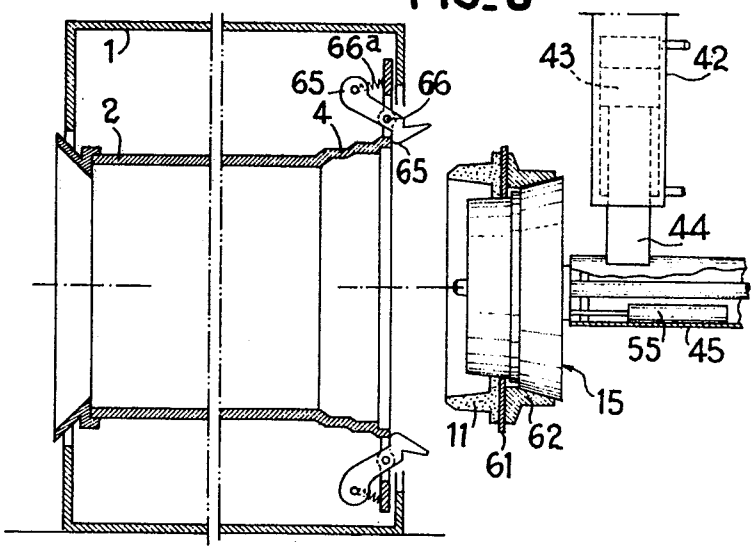
FIGS. 8 to 10 are sectional views of two successive stages of the fixing of the core to the end of the centrifugal casting mould by means of the second support of the handling installation.

The centrifugal casting machine shown in FIG. 1 comprises a case 1 open at both ends and in which a casting mould 2 is carried by rollers 3 which are capable of driving the mould in rotation at high speed about its substantially horizontal axis X—X. The mould 2 has at one end a socket 4 and is adapted to cast iron pipes having a socket of large diameter, for example between 800 and 2000 mm. An outline of a human being 5 is shown next to the case 1 in order to reveal the large size of the machine. In the extension of the case 1, at the end opposed to the socket 4, a runway 6 carries a carriage 6*a* on which a pouring trough 7 is fixed. This trough 7 extends in a cantilever manner out of the carriage 6*a* in the direction of the case 1 to an extent at least equal to the length of the mould 2. A pouring chute 8 extending upstream of the trough 7 is supplied with molten iron from a tiltable ladle 9 pivoted on the carriage 6*a*.

The centrifugal casting machine is associated with an installation 10 for handling socket cores 11. The cores are intended to be fixed in the socket of the mould 2 before each casting in order to define the internal profile of the socket of the cast pipe. The handling installation 10 comprises mainly an overhead travelling crane 12 movable above the case 1 and a horizontal runway 13 perpendicular to the axis X—X, a first support 14 disposed in the vicinity of the production station (not shown) of the cores 11 and also in the vicinity of the end of the runway 13 remote from the case 1, and core transferring means comprising a second support 15 suspended from a carriage 16 movable on the overhead crane 12 in a direction parallel to the axis X—X.

Figure 3:
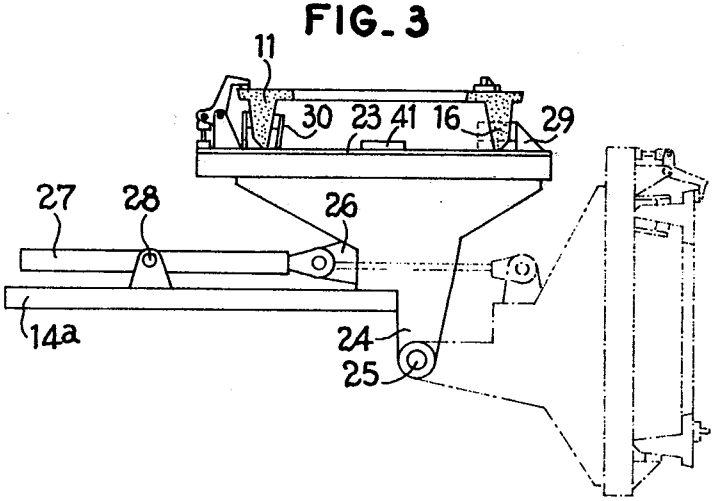
FIG. 3 is a diagrammatic sectional view, to a scale larger than FIG. 1, of a first support of the installation shown in FIG. 1 on which support the core shown in FIG. 2 is positioned.
Figure 4:
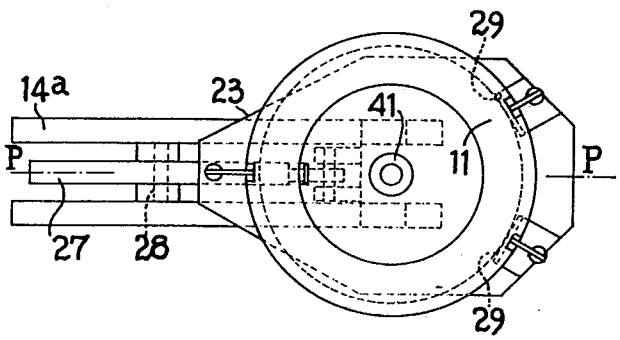
FIG. 4 is a plan view of the support shown in FIG. 3.

Each core 11, shown to an enlarged scale in FIG. 2, comprises an annular skirt portion 16 having externally the desired relief or contour 17. Provided at one end of the skirt portion 16 is an annular radially outwardly extending flange 18 for fixing and centering the core in the socket 4 of the mould 2. This flange 18 is extended radially inwardly by an inner flange 19 which extends radially into the annular space defined by the skirt portion 16. The flange 19 has a roughly cylindrical radially inner face and the same thickness as the flange 18 and defines with the latter a planar end face of the core. The core 11 is constructed in one piece from sand agglomerated by a hardening binder. When the core 12 is placed flat on some support, immediately after its production, a simple swing bar, constituted by a bar 21, cranked in its middle in the form of an inverted V and suspended from a cable 22 can be introduced, by tilting, in the cavity of the core through the opening defined by the flange 19 and bear by end portions of the bar 21 on the lower face of the flange 19 so as to raise the core and position it on the first support 14 which will now be described with reference to FIGS. 3 to 5.

The first support 14 comprises a support plate 23 carried by a foot 24 which has an end mounted to pivot about a fixed horizontal pin 25 and is provided, roughly midway up its length, with an ear 26 on which there is pivoted the end of the piston rod of a tilting jack 27 whose body is pivoted at 28 to the frame 14a of the support 14. When the jack 27 is retracted, the plate 22 is horizontal, when the jack 27 is extended, it pivots the plate 22 about the axis 25 until it is brought to a vertical position shown in dot-dash line in FIG. 3.

Mounted on the plate 23 are means for positioning and maintaining the core 11. Thus the plate 23 carries a number of abutments 29 provided with shoes or blocks 29a adapted to come in contact with the outer periphery of the skirt portion 16 of the core and thereby position the latter. In the illustrated embodiment, two abutments 29 are provided which are disposed symmetrically with respect to the plane of symmetry P—P of the support 14 and on the side of the plate 22 opposed to the jack 27 which is also contained in the plane P—P.

In this plane P—P, and adjacent the jack 27, there is provided a tongs 30 whose two arms 31 and 32 are pivotably mounted on horizontal pins 33, 34 carried by the plate 23 and have a free end which is provided with a shoe 36 and projects above the upper surface of the plate 23. The tongs 30 is actuated by a jack 35. When the latter is actuated, the two free ends of the arms of the tongs 30 move toward each other for gripping the skirt portion 16 of the core 12 disposed between the arms. By way of a modification, one of the two arms of the tongs 30 may be fixed and disposed in such manner as to bear against the corresponding wall of the skirt portion 16. For example, there has been shown in dot-dash line in FIG. 5 a fixed abutment 37 which is adapted to bear against the inner wall of the skirt portion 16 and replaces the movable arm 32 of the tongs 30.

The means for maintaining the core and the first support 14 are constituted by S-shaped levers 38 which are pivoted at a cranked portion 38a thereof to brackets 38b fixed to the plate 23. The upper end of each lever 38 carries a shoe 39 for bearing against the planar end face 20 of the core 11 whereas its other end is engaged by the end of the piston rod of a jack 40. When the latter is retracted, it disengages the corresponding lever 38 until the inclined position shown in dot-dash line in FIG. 5 is reached. In the illustrated embodiment, three pivoted levers 38 are provided, one of which is in the plane P—P adjacent the jack 27 whereas the other two are positioned roughly in the same manner as the two abutments 29. The plate 23 carries a centre cylindrical hub 41.

Note that the abutments 29, the tongs 30, the pivotal levers 38 and the hub 41 are all mounted on slides which are movable in radial slideways provided on the plate 23 so as to be suitably adjusted in position on the plate 23 for receiving cores 11 of different diameters. In the interest of simplification and clarity, these slideways have not been shown in the drawing. It will be understood that the plate 23 is detachable and may be replaced by an another similar plate if the diameter of the cores 11 are outside the range permitted by the adjusting slides.

The second support 15 (FIGS. 6 and 7) is suspended from the carriage 16 carried by the overhead crane 12 by means of a telescopic hollow column 42 having internally a jack 43 for raising and lowering the support 15. By way of a modification, the column 42 could contain an equivalent vertical displacement mechanism, for example a worm and wormwheel system or a rack and pinion system driven by an electric motor.

The lower end of the piston rod 44 of the jack 43 carries a horizontal hollow cylinder 45 in which bearings 46 are provided. The bearings serve as guide means for a hollow rod 47 at the end of which there is fixed an annular cup member 48 whose horizontal axis Y—Y coincides with that of the hollow rod 47. Starting from the end of the rod 47, the cup member 48 has a first planar end face 49 on which the rod 47 is fixed, a first convergent frustoconical bearing portion 50, a cylindrical portion 51 and a second frustoconical bearing portion 52 whose conicity is distinctly less than that of the bearing portion 50. Radial shoulders are defined between the three portions 50, 51 and 52 of the cup member 48. A second end face 53, parallel to the first end face, closes the space defined by the cup member 48 and carries at its centre a frustoconical point 54 whose maximum diameter corresponds to the diameter of the bore of the hub 41 of the first support 14. A jack 55, fixed inside the hollow cylinder 45, enables the cup member 48 to be bodily shifted coaxially with respect to the cylinder 45.

Two small jacks 56 and 57 are fixed radially inside the cup member 48. The free ends of their piston rods constitute pins 58 and 59 which are slidable in radial openings formed respectively in the peripheral wall of the portions 51 and 52 of the cup member 48 and are capable of extending radially beyond these peripheral walls when the jacks 56 and 57 are extended. Inlet and outlet conduits 60 for the jacks 56 and 57 extend through the hollow rod 47.

The handling installation also has an annular core-backing means comprising a plate 61 and a ring 62 whose function will be clear hereinafter. The plate 61 is annular and adapted to be capable of bearing against the shoulder defined between the bearing surface 52 and the cylindrical portion 51 of the cup member 48. The ring 62 is fixed to one face of the plate 61 and has internally a cylindrical portion 63 which has roughly the same length as the cylindrical portion 51 of the cup member 48 and is extended by a frustoconical portion 64 which is conjugate with the frustoconical portion 50 of the cup member 48.

The handling installation described hereinbefore is employed for fixing the core 11 to the socket end 4 of the mould 2 shown in FIG. 8. Evenly spaced apart about the free end of the socket 4 are holding means in the form of a number of keys 65, for example three keys, actuated by centrifugal force and mounted to pivot about pins 66 carried by a radial end flange of the socket 4. The keys 65 are permanently biased by return springs 66a mounted on the same flange, these springs tending to apply the keys against the end edge face of the socket 4. Moreover, the balancing of the masses of the parts of each key 65 located on each side of its pin 66 is such that, when the mould 2 is rotating, these keys tend to apply themselves more strongly against the end edge face of the socket 4. The active end 65a of the keys 6 have a curved nose portion.

The installation just described operates in the following manner:

With the core 11 at the production station, placed flat, the swing bar 21 is introduced inside the core through the centre opening, left free, defined by the inner flange 19. The core 11 is then raised by the swing bar 21 and brought above the plate 23 of the support 14, which is in a horizontal position. After having deposited the core on the plate 23 so that the outer periphery of the skirt portion 16 bears against and is positioned by the abutments 29, the jack 35 is actuated in such manner as to close the tongs 30 and grip the skirt portion 16 of the core. The jacks 40 are then actuated and this pivots the lever 38 and brings the shoes 39 of the latter in contact with the upper face 20 of the core 11. The latter is then held firmly on the plate 23.

The jack 27 is then extended and this pivots the assembly comprising the support 14 and the core 11 about the pivot pin 25 until the plate 23 and the face 20 of the core 11 is brought into a vertical position.

Figure 6:
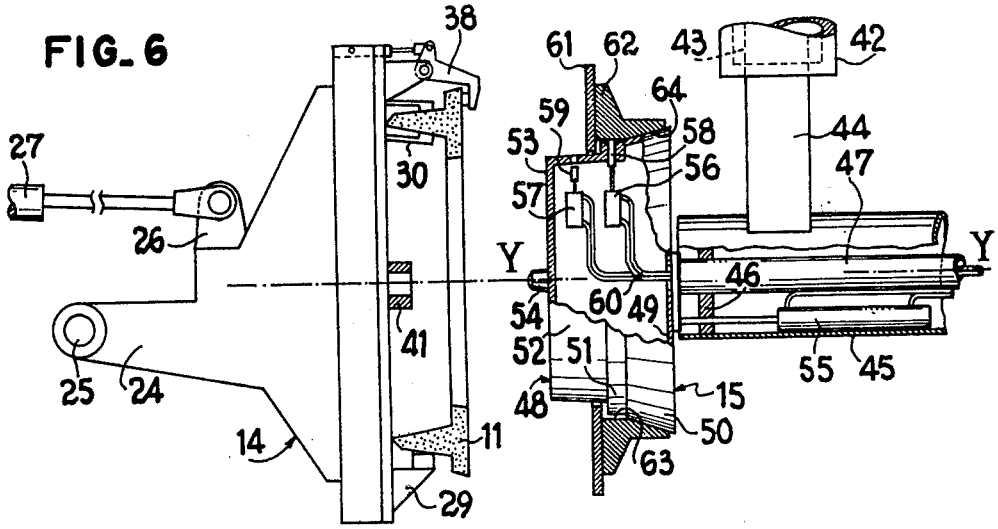
FIGS. 6 and 7 are sectional views of two successive stages of the transfer of the core from its first support to a second support.
Figure 7:
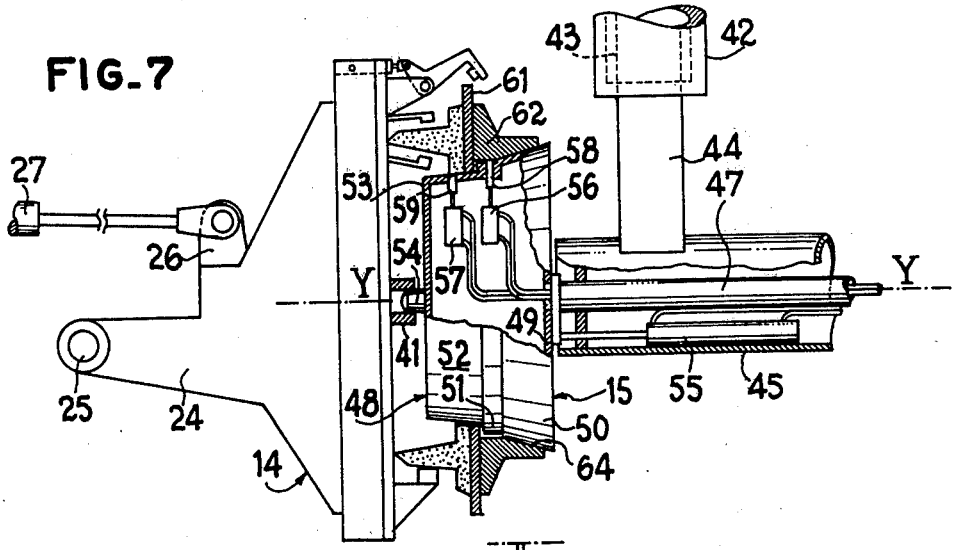

By means of the jack 43 and the overhead crane 12 the second support 15 is brought in front of the first support 14 which is substantially coaxial with the latter (FIG. 6). The second support 15 carries core-backing means comprising the plate 61 and the ring 62, the lug 58 being in bearing relation against the latter and the lug 59 being retracted. Thereafter, the S-shaped levers 38 are spread apart and the supports 14 and 15 are coupled by penetration of the frustoconical point 54 of the support 15 in the centre hub 41 of the support 14. In the course of this coupling, the core 11 is engaged on the frustoconical bearing portion 52 of the cup member 48 until it comes into bearing relation against the face of the plate 61 remote from the ring 62 (FIG. 7). Note that, in this position, a slight radial clearance is formed between the inner flange 19 of the core 12 and the peripheral surface of the bearing portion 52. By extension of the jack 57, the lug 59 seizes the core by the radially inner face of its flange 19.

Figure 10:
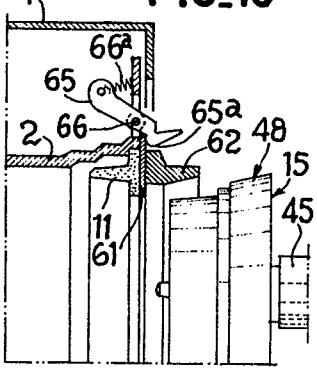

The tongs 30 is then opened, the support 15 is moved away from the support 14 and the latter is brought to the horizontal position. Then, through the agency of the overhead crane 12 and the jack 43, the support 15 is brought into a position coaxial with the socket 4 of the mould 2 (FIG. 8) and the support 15 is moved toward the socket until the periphery of the plate 61 is located very near to the nose portions **65*a* of the keys 65. Then the jack 55 is actuated to introduce the core in its recess in the socket. In the course of this movement, the face 61 bears against the curved nose portions 65*a* of the keys 65, elastically urges the latter outwardly in opposition to the force exerted by the springs 66*a*, and comes in contact with the end face of the socket 4. The keys 65 then move back elastically and come into bearing relation with the face of the plate 61 remote from the core. Simultaneously, the lug 59 is retracted and this allows the core a certain clearance which enables it to centre itself perfectly well by its outer flange 18 in a shoulder provided at the entrance of the socket 4. The lug 58 is then retracted and this releases the plate 61 and the ring 62 and the jack 55 is retracted so as to move the cup member 48 away from the mould (FIG. 10). The latter thus carries at its end, for the casting operation, the core 11, the support face 61 (which serves to transmit to the flange 18 of the core the locking thrust exerted by the keys 65), and the ring 62 which performs the function of a protective screen against possible projections of iron. Thereafter, the second support 15 is laterally withdrawn during the casting which is carried out in a conventional manner in the course of a to-and-fro movement of the carriage 6*a* on the runway 6**.

Figure 9:
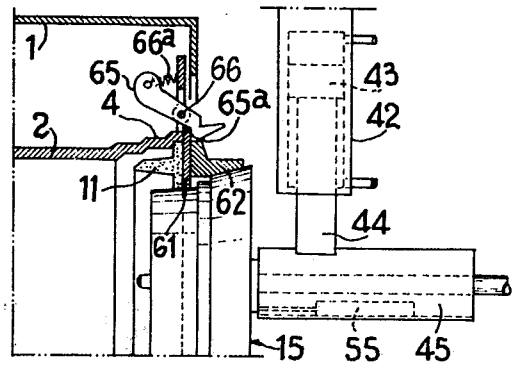

After casing, the procedure is reversed in that the support is brought against the socket end of the mold as shown in FIGS. 10 and 9 and then shifted away from the mold as shown in FIG. 8. More specifically, the second support 15 is brought onto the axis X—X of the mould 2 and very near to the ring 62, then, by extending the jack 55, the bearing portion 50 is brought in contact with the frustoconical surface 64 of the ring 62. The lug 58 is then made to project and seizes internally the ring 62 by its cylindrical portion 63, and also the lug 59 is made to project and comes in contact with the flange 19 of the core. The jack 55 is retracted and this causes the plate 61 to pass beyond the keys 65 by raising them elastically in opposition to the action of their return springs 66. The core 11, which cannot be stripped from the cast pipe, is broken in the course of this movement and falls in the form of broken pieces and fully clears the bearing portion 52 of the cup member 48. It will be understood that there would be no core on the support 15 in the position of the latter shown in FIG. 8 after the casting of the pipe. The lug 59 is then retracted and the support 15 is ready to be returned to the position shown in FIG. 6 in facing relation with the support 14, which has in the meantime received a new core 11 for effecting a new cycle of handling operations.

Figure 11:
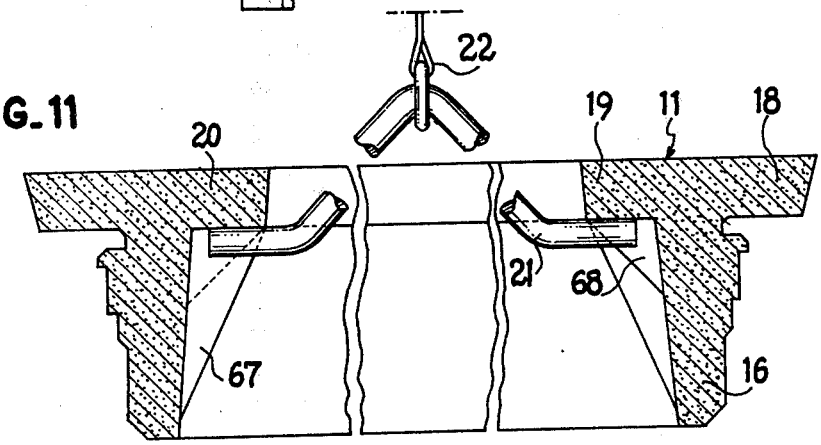
FIG. 11 is a view similar to FIG. 2 of a modification of the core shown in FIG. 2.

The core 11 permits, by its flange 19, its raising by the swing bar which is very simple. The transfer of the core to the first support 14 by means of the swing bar is the sole manual operation of the entire handling and is very easily carried out with no danger. The flange 19 also provides a radial bearing surface for the gripping of the core by the lug 59. Note that cores of larger diameters, for example 1500 to 2000 mm diameter, are reinforced internally by ribs 67 and 68 (FIG. 11) and can thus be made proportionally thinner than cores of smaller size, namely 800 to 1400 mm.

The overall time of the handling operations carried out with the installation described hereinbefore is very short, 2 to 3 minutes are sufficient for shifting a core weighing several hundred kilograms a distance of about 30 m with changes in plane and level. Moreover, each transfer operation is sure and precise and the centering is perfect. In particular, the coupling 41–54 of the two supports 14 and 15 solves in a simple and precise manner the problem of the transfer of cores from one device to another.

Note also that, with respect to the core, whereas the support 14, devoid of a centering bearing portion such as 52, has, on the other hand, outer abutments 29 in combination with a tongs 30 and pivoted jaws 38, the support 15 is merely provided with a centering bearing portion 52 and a withdrawable blocking means 59. The reason for this is that the pivotable support 14 must neither allow the core 11 to escape nor enable it to move during the pivoting, whereas the support 15 more easily holds the core 11 in position constantly "on edge" and must introduce it rapidly in the mould 2 and release it immediately once it is perfectly lodged and fitted in the socket 4 of the mould.

In the embodiment shown in FIGS. 12 to 14, the expansible gripping means of the second support **15*a* may be mechanical, instead of being hydraulic or pneumatic, employing jacks 56–57 and blocking lugs 58–59**.

For this purpose, inside the cup member **48*a*, which does not have a cylindrical portion between the two conical bearing portions 50*a* and 52, there is disposed a pair of expansible sets of jaws, for example three in each set, having rollers or wheels 69** evenly spaced apart around the axis Y—Y and mounted in the following manner:

Each wheel 69 is freely rotatable on the corner of a triangle 70 pivoted at 71 to a respective support disc 72 or, 73 which is fixed with respect to the cup member 48.

The pivotal connection 71 is located at another corner of the triangle 70, whereas at the third corner of the latter there is freely rotatable a roller 74 which is cooperative with a respective center disc cam 75 or 76. Each cam 75 or 76 is in alignment with the triangles 70 and carries three progressive projections 77 which are evenly spaced apart and capable of causing the three corresponding wheels 69 to project simultaneously out of the cup member 48*a* by a suitable rotation of the triangle 70 due to a rotation of the cam. The cams 75 and 76 are connected to rotate with a single shaft 78 having an axis Y—Y and journalled in a tubular cylinder 78. The shaft 79 is driven in rotation by a crank 80 actuated by a jack 81, the latter being mounted at the end of the cylinder 79 opposed to the cup member 48*a*. The triangles 70 are provided with return springs for returning them to a retracted position.

The cams 75 and 76 are thus mounted in parallel and connected to rotate, one in the region of the bearing portion 50*a*, and the other in the region of the bearing portion 52*a* of the cup member 48*a* so as to cause the wheels 69 to project on these bearing portions. The only jack 81 and the only crank 80 of the common shaft 78 actuate the two sets of expansible jaws 69 independently of each other. This result is obtained by an appropriate conformation and angular offsetting of the disc cams 75 and 76.

Note that a jack 55*a* fixed outside the suspended cylinder 45*a* enables the tubular cylinder 79 to be shifted in translation in the cylinder 45*a* in both directions. For this purpose, three sets, 82, 83 and 84, of co-planar radial rollers are freely rotatable inside the tubular cylinder 65*a* and roll on the outer surface of the cylinder 79. This mechanism is advantageous owing to the low inertia of the rollers 82 to 84 and consequently the small amount of energy required for actuating the jack 55*a*.

We claim:

1. An installation for the mechanical handling of a socket core which is of revolution about an axis and intended to be fixed in a socket end of a centrifugal casting mold which is rotatable about an axis, the installation comprising, in combination with said mold, a first support having an axis for carrying the core in a position coaxial with the first support and pivotable about a fixed pivot axis between a horizontal first position in which first position the axis of the first support is vertical and a vertical second position in which second position the axis of the first support is horizontal, means for positioning the core coaxially with the first support in said horizontal first position of the first support and releasable means for maintaining the core on the first support in said coaxial position, mechanical core carrying means for conveying the core along from a core producing station to the first support and placing the core on the first support to engage said means for positioning the core, annular core-backing means for mounting on the socket end of the mold and retaining the core in position on the socket end during casting, releasable holding means combined with the socket end of the mold for engagement with and holding the core-backing means on the socket end during casting, transferring means for combining the core and the core-backing means and transferring the core combined with the core-backing means from the first support to the socket end of the mold for mounting the core and core-backing means on the socket end by the action of said holding means and leaving the core-backing means on the socket end during casting, returning to the core-backing means after casting and transferring the core-backing means to a position for receiving a new core alone from the first support, said transferring means consisting essentially of a second support having a horizontal axis for supporting the core and the core-backing means in a removable manner in positions substantially coaxial with the second support, means guidingly carrying the second support and allowing the second support to the movable between a first position in which the second support is adjacent and coaxial with the first support in said second position of the first support to permit transferring the core alone from the first support to the second support and putting it in abutment with the core-backing means on the second support and a second position in which the second support is adjacent said socket end and the axis of the second support is in axial alignment with said axis of rotation of the mold for transferring the core and the core-backing means to said socket end, first releasable gripping means carried by the second support for retaining the core on said second support and second releasable gripping means carried by the second support for retaining the core-backing means on the second support during the movement of the second support between said first and second positions of the second support, the two supports being provided with interengageable centering means operative independently of the core in said first position of the second support and said second position of the first support, said means carrying the second support allowing the second support to be movable transversely of said axis of rotation of the mold.

2. An installation as claimed in claim 1, wherein said fixed pivot axis is perpendicular to the axis of rotation of the mold and the second support is also movable in horizontal translation in a direction parallel to said axis of rotation.

3. An installation as claimed in claim 2, wherein said means carrying the second support comprises an overhead travelling crane located above the supports and a movable carriage carried by the crane, the second support being suspended from the carriage.

4. An installation as claimed in claim 3, comprising a telescopic column through which column the second support is suspended from the carriage and means for regulating the length of the column.

5. An installation as claimed in claim 3, wherein the second support is movable in translation with respect to the carriage in a direction parallel to the axis of rotation of the mould.

6. An installation as claimed in claim 5, comprising a first tubular element and a second tubular element, the second tubular element being suspended from the carriage and carrying internally a plurality of coplanar groups of radial rollers and the first tubular element being rollingly supported by the rollers and axially movable of the second tubular element.

7. An installation as claimed in claim 1, wherein one of the two supports is porvided with a male element and the other of the two supports is provided with a female element which elements constitute said centering means for the centering of the two supports, at least one of said male and female elements being mounted on the corresponding support in an adjustable

8. An installation as claimed in claim 1, wherein said positioning means comprise peripheral abutments mounted in an adjustable position on the first support.

9. An installation as claimed in claim 1, wherein said means for maintaining the core comprise peripheral pivotable levers mounted in adjustable positions on the first support and having one end which is adapted to come in contact with an end face of the core which end face is remote from the first support.

10. An installation as claimed in claim 9, wherein said core means for maintaining the core further comprise a tongs mounted in an adjustable position on the first support and capable of gripping a wall of the core defining an annular skirt portion of the core.

11. An installation as claimed in claim 1, wherein the second support has means for substantially centering the core on said axis of the second support.

12. An installation as claimed in claim 11, wherein said core-centering means of the second support comprise a centering bearing portion for penetrating the core with a radial clearance.

13. An installation as claimed in claim 1, wherein the annular core-backing means comprise a plate for axially supporting the core on the second support and for cooperation with said holding means for retaining the core on said socket end of the mold when casting.

14. An installation as claimed in claim 13, wherein the plate is annular and carries a ring on a side thereof opposed to the side supporting the core, the second support being provided with a bearing portion for centering said ring.

15. An installation as claimed in claim 14, wherein the second gripping means cooperate with the ring.

16. An installation as claimed in claim 14, wherein said first griping means and said second griping means comprise two sets of coplanar rollers respectively corresponding to the core and to the ring, and a single cam shaft cooperative with the two sets of rollers for actuating the two sets of rollers separately.

17. An installation as claimed in claim 1, wherein said first gripping means and second gripping means each comprise at least one retractable element for bearing against the inner face of the core and core-backing means respectively.

18. An installation as claimed in claim 17, wherein the retractable element is a pin carried by the end of a piston rod of a jack.

19. An installation as claimed in claim 17, wherein the retractable element is a roller carried by a lever, a cam being provided to actuate the lever.

20. An installation as claimed in claim 1, wherein the mechanical core-carrying means comprise a swing bar bent in the middle thereof in the form of an inverted V and suspended from a cable for shifting the core from the station for producing the core to the first support, the core having a radially inwardly extending flange for engagement by said swing bar.

* * * * *